US006359589B1

(12) United States Patent
Bae

(10) Patent No.: US 6,359,589 B1
(45) Date of Patent: Mar. 19, 2002

(54) MICROSTRIP ANTENNA

(75) Inventor: Jae Kyun Bae, Kyungki-do (KR)

(73) Assignee: Kosan Information and Technologies Co., Ltd. (KR)

( * ) Notice: Subject to any disclaimer, the term of this patent is extended or adjusted under 35 U.S.C. 154(b) by 0 days.

(21) Appl. No.: 09/603,558

(22) Filed: Jun. 23, 2000

(51) Int. Cl.[7] ..... H01Q 1/38
(52) U.S. Cl. ..... 343/700 MS; 343/846; 343/848
(58) Field of Search ..... 343/700 MS, 846, 343/848; 333/236, 27

(56) References Cited

U.S. PATENT DOCUMENTS 4,490,697 A * 12/1984 Yasuda et al. ..... 333/156
5,781,158 A * 7/1998 Ko et al. ..... 343/700 MS
6,121,932 A * 9/2000 McCoy et al. ..... 343/700 MS

* cited by examiner

*Primary Examiner*—Tho Phan
*Assistant Examiner*—James Clinger

(74) *Attorney, Agent, or Firm*—Snell & Wilmer

(57) ABSTRACT

A microstrip antenna (100) having a ground patch (40) on which at least a feed line (30) is located, and a dielectric (50) laminated on the ground patch (40). The microstrip antenna (100) includes a left radiation patch (61) short-circuited to one end of the ground patch (40) and laminated on a left upper surface of the dielectric (50), and a right radiation patch (62) short-circuited to the other end of the ground patch (40) and laminated in an array on a right upper surface of the dielectric (50) with a radiation slot (70) arranged between the left and right radiation patches (61 and 62) so that capacitance is implemented between the left and right radiation patches (61 and 62). The ground patch (40) includes a right ground plate (41) having a triangular area extending from a feed point of a feed line (30) to both corners of a right lower surface of the dielectric (50) to which the right radiation patch (62) is short-circuited, a connection plate (42) having a narrow width (W2) and extending as long as a height (l5) of the right ground plate (41) from the feed point to the left radiation patch (61) to implement an inductance, and a left ground plate (43) connected to the connection plate (42) and covering a left lower surface of the dielectric (50). The microstrip antenna can improve its gain by reducing leakage current as well as it has a wide frequency band, and can be built in various kinds of wireless communication equipment.

2 Claims, 11 Drawing Sheets

A : 1.74 GHZ
B : 1.78 GHZ
C : 1.8 GHZ
D : 1.84 GHZ
E : 1.87 GHZ

MICROSTRIP ANTENNA

BACKGROUND OF THE INVENTION

1. Field of the Invention

The present invention relates to a microstrip antenna. In particular, the present invention relates to a microstrip antenna which can minimize leakage current by separately arraying a left radiation patch and a right radiation patch on an upper surface of a dielectric so that they have an electric field of the same phase, and which can minimize its size and thus can be built in various kinds of wireless communication equipment such as portable mobile terminals by improving its standing-wave ratio and gain so that it has a wide bandwidth.

2. Description of the Prior Art

Generally, frequencies mainly used in mobile radio communications are in the range of 150~900 MHz. Recently, according to the rapidly increasing demand therefore, frequencies of a pseudo-microwave band in the range of 1~3 GHz are also used.

In applying the pseudo-microwave band to the mobile radio communications, personal communication service (PCS) has already used a frequency range of 1.7~1.8 GHz, and next-generation mobile radio communication systems such as GMPCS (1.6 GHz), IMT2000 (2 GHz), etc., will also use the pseudo-microwave band to enable communications through all places of the world.

As portable telephones become small-sized and high-graded by their rapid development, the importance of their antennas have been naturally highlighted, and as an example, a microstrip antenna has been presented as the subject of special research in this field.

Typically, the microstrip antenna has a better efficiency as a dielectric constant becomes lower, and a substrate becomes thicker. Also, since the microstrip antenna has a low efficiency in case of using a low frequency, but has a high efficiency in case of using a high frequency, it can be considered as the very antenna that can satisfy the limited condition of miniaturization that the portable telephone pursues.

Meanwhile, a typical microstrip antenna has a structure in which radiation patches having a resonance length of $\lambda/2$ are attached on a wide ground patch, and has the form of an array. Between the patches on the left and right sides of a feed point and the ground patch are formed lines of electric force. If the ground patch is short on the left and right sides of the feed point, this limits the formation of the lines of electric force, and thus lowers the gain of the antenna, causing the of miniaturization of the antenna to be difficult.

The microstrip antenna has a simple structure in which a dielectric is formed on the ground patch, and rectangular or circular radiation patches are attached on the upper surface of the dielectric, and thus it has drawbacks in that it has a narrow bandwidth and a low efficiency. However, it has advantages in that it can be manufactured at a low cost with a small size and a light weight, and thus it is suitable to mass production.

Also, since it can be wound on various devices and components with a predetermined form due to its free banding characteristic and can be easily attached to an object moving at a high speed, it has been widely used as a transmission/reception antenna of a flying object such as a rocket, missile, airplane, etc.

In addition, the microstrip antenna can be designed on a circuit board together with solid-state modules such as an oscillator, amplifying circuit, variable attenuator, switch, modulator, mixer, phase shifter, etc.

The microstrip antenna as described above may be designed so as to have one or two feed points and circular or rectangular radiation patches in a satellite communication system that requires circularly polarized waves. Also, it can be used for a Doppler radar, radio altimeter, remote missile measuring device, weapon, environmental machine and its remote sensor, transmission element of a composite antenna, remote control receiver, radiator for biomedicine, etc.

As a result, with the rapid spread of mobile communication terminals such as telephones for vehicles, pocket bells, cordless telephones, etc., due to the rapid development of information processing, the equipment for such mobile communications becomes small-sized, and this demands that the antenna thereof also to become small-sized.

FIG. 1 is a side view illustrating a general microstrip antenna. Referring to FIG. 1, the general microstrip antenna has a radiation patch 1 both ends of which are open, and thus the current distribution of which is 0 and the voltage distribution of which is a maximum value. A feed position is determined as the ratio of the current distribution value to the voltage distribution value in accordance with the resistance value of a feed line 2.

Also, lines of electric force, 3 and 5, can be considered to be divided into a vertical component and a horizontal component, respectively. The vertical components are cancelled due to their opposite phase to each other, and the horizontal components exist in array due to their same phase.

If the length of the ground patch 6 in the microstrip antenna is determined to be short, the range where the lines of electric force, 3 and 5, exert is limited, and this results in attenuation of the gain. Thus, shortening the ground patch 6 cannot achieve the miniaturization of the antenna.

Generally, the microstrip antenna is a unit of a VHF/UHF band, and is required to have a compact and light-weighted structure. As the presently developed microstrip antenna, a quarter-wavelength microstrip antenna (QMSA), post-loading microstrip antenna (PMSA), window-attached microstrip antenna (WMSA), frequency-variable microstrip antenna (FVMSA), etc., exist. The PMSA, WMSA, and FVMSA are provided by partially modifying the QMSA, and thus basically have similar radiation patterns to one another.

FIG. 2 is a perspective view illustrating the structure of a conventional QMSA. Referring to FIG. 2, according to the conventional QMSA, a radiation patch 23 and a ground patch 21 are constructed so that they have an identical width W, and the ground patch 21 extends in a direction opposite to a radiation opening 22 to provide a small-sized antenna that can be mounted in a limited space of a small-sized radio device.

Specifically, according to the QMSA of FIG. 2, a dielectric 22 and the radiation patch 23 are successively attached to the ground patch 21 of $\lambda g$ (guide wavelength)/2, one end of the ground patch 21 is short-circuited to the radiation patch 23, and the length of the radiation patch 23 is determined to to be $\lambda g/4$ to have a fixed frequency range.

Also, an outer conductor of a feed line 24 is grounded to the ground patch 21, and an inner conductor (center conductor) of the feed line 24 is connected to the radiation patch 23 through the ground patch 21 and the dielectric 22 (Japanese Electronic Information Society, Vol. J71-B, 1988.11.). Typically, polyethylene ($\epsilon r$=2.4), Teflon ($\epsilon r$=2.5), or epoxy-fiberglass ($\epsilon r$=3.7) can be used as the dielectric 22.

FIG. 3 shows the variation of the gain ratio according to the variation of Gz in FIG. 2. In FIG. 2, 0 (dB) represents the gain of a basic half-wavelength dipole antenna. Gz plays a very important role for determining the increasing rate of radiation. FIG. 4 shows the variation rate of gain according to the whole length L of the antenna of FIG. 2, and FIG. 5 shows the gain ratio to the width W of the radiation patch 23 of FIG. 2.

FIG. 6 shows the measured radiation property of the QMSA of FIG. 2. In FIG. 6, (A), (B), (C) represent an XY plane, YZ plane, and ZX plane, respectively. As shown in FIG. 6, it can be recognized that the QMSA of FIG. 2 is an electric field antenna having the radiation patterns in all propagation directions. The radiation characteristics of the QMSA are obtained by determining parameters of the antenna as the whole length L of the antenna=7.67 cm, Gz=2.79 cm, the width W of the radiation patch 23=3 cm, the width t of the dielectric 22=0.12 cm, and dielectric constant $\epsilon r$=2.5 (Teflon).

Meanwhile, when the standing-wave distribution is positioned near its minimum point in a complicated city environment, the transmission/reception sensitivity of the electric field antenna deteriorates due to the diffraction, reflection, etc., of the signal, and this causes the communication to be disturbed.

Accordingly, the current radio equipment or system uses a spatial diversity, directional diversity, polarized diversity, etc. Meanwhile, two or more antennas may be installed to solve the low reception sensitivity caused by a multipath.

Meanwhile, according to the PMSA (not illustrated) which is a modified microstrip antenna, two radiation open surfaces are formed on both sides of a radiation patch, a short-circuited post is connected to a ground patch and the radiation patch through a dielectric instead of a short-circuited end of the QMSA antenna, and a feed line is located at a predetermined distance from the short-circuited post. Though the PMSA has two open surfaces, the radiation pattern thereof is substantially similar to that of the QMSA.

Also, according to the WMSA (not illustrated) which is a modified microstrip antenna, a slit is formed at a predetermined distance from the radiation patch of the QMSA to have a reactance component, and thus the length of the radiation patch can be shortened. According to the FVMSA (not illustrated), the resonance frequency of the QMSA can be electronically changed in accordance with the change of the reactance load value.

However, the conventional modified microstrip antennas, i.e., the QMSA, PMSA, WMSA, and FVMSA have drawbacks in that if the ground patch is determined to be small, the radiation open surfaces become narrow, and their gains are rather attenuated, so that they cannot be small-sized. Also, if they are used for portable radio equipment, the field strength thereof deteriorates due to walls of a building and various metals in the building, and the receiving sensitivity deteriorates due to the multipath interference.

SUMMARY OF THE INVENTION

It is an object of the present invention to solve the problems involved in the related art, and to provide a microstrip antenna which can greatly miniaturize its size without attenuation of its gain and without limiting the range of lines of electric force between a ground patch and radiation patches, and which can have a wide bandwidth by implementing a greater gain on a capacity-loaded side rather than the ground patch.

In order to achieve the above object, there is provided a microstrip antenna having a ground patch on which at least a feed line is located, and a dielectric laminated on the ground patch, the microstrip antenna comprising a left radiation patch short-circuited to one end of the ground patch and laminated on a left upper surface of the dielectric, and a right radiation patch short-circuited to the other end of the ground patch and laminated in an array on a right upper surface of the dielectric with a radiation slot arranged between the left and right radiation patches so that capacitance is implemented between the left and right radiation patches, wherein the ground patch includes a right ground plate having an area of a triangle formed by a feed point of a feed line and both corners of a right lower surface of the dielectric to which the right radiation patch is short-circuited, a connection plate having a narrow width and extending as long as a height of the right ground plate from the feed point to the left radiation patch to implement an inductance, and a left ground plate connected to the connection plate and covering a left lower surface of the dielectric.

Preferably, the microstrip antenna according to the present invention further includes a mounting piece having a bent shape and attached to a center portion of a left end of the left radiation patch, one side surface of the dielectric, and the left ground plate to provide a height for enabling the ground patch to be separately mounted.

BRIEF DESCRIPTION OF THE DRAWINGS

The above object, other features and advantages of the present invention will become more apparent by describing the preferred embodiment thereof with reference to the accompanying drawings, in which.

DESCRIPTION OF THE PREFERRED EMBODIMENTS

The construction and operation of the present invention will be explained in detail with reference to the accompanying drawings.

Figure 1:
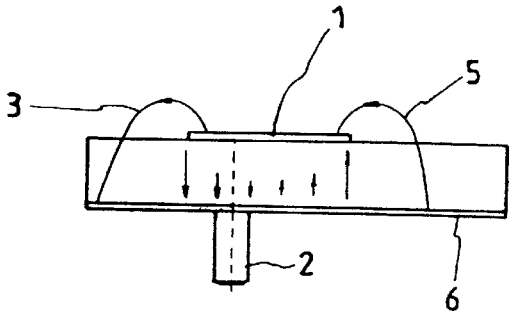
FIG. 1 is a side view illustrating a general microstrip antenna.
Figure 2:
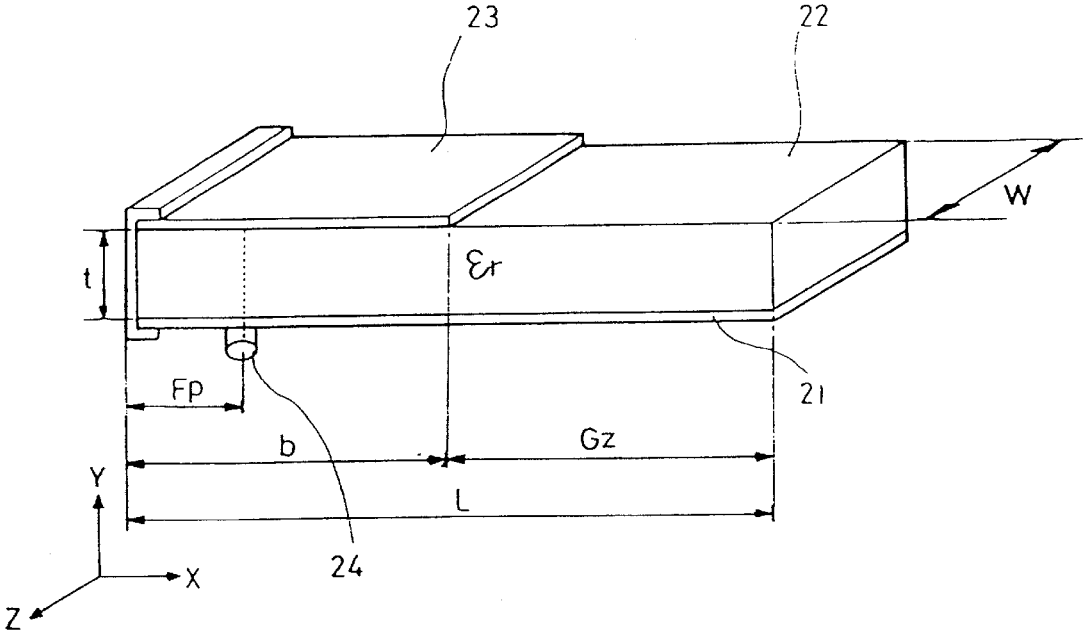
FIG. 2 is a perspective view illustrating the structure of a conventional QMSA antenna.
Figure 3:
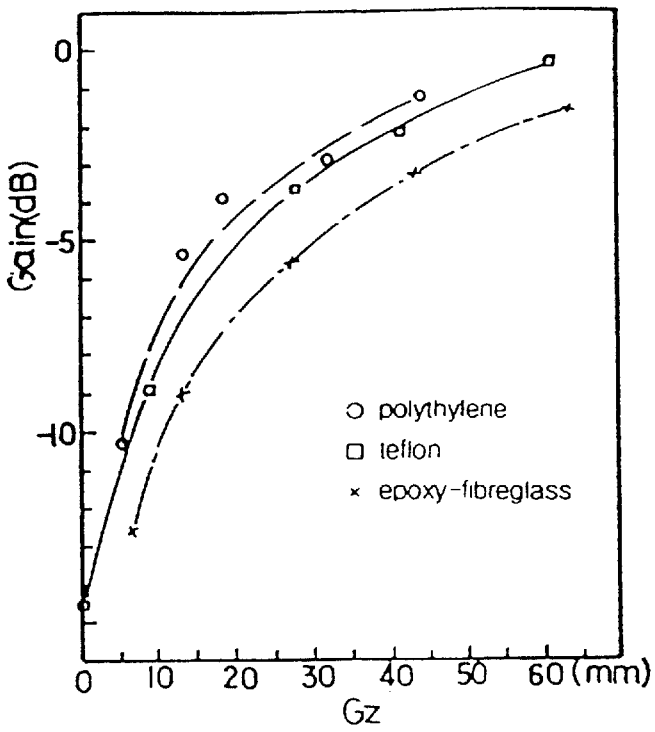
FIG. 3 is a graph illustrating the gain relationship with respect to Gz in FIG. 2.
Figure 4:
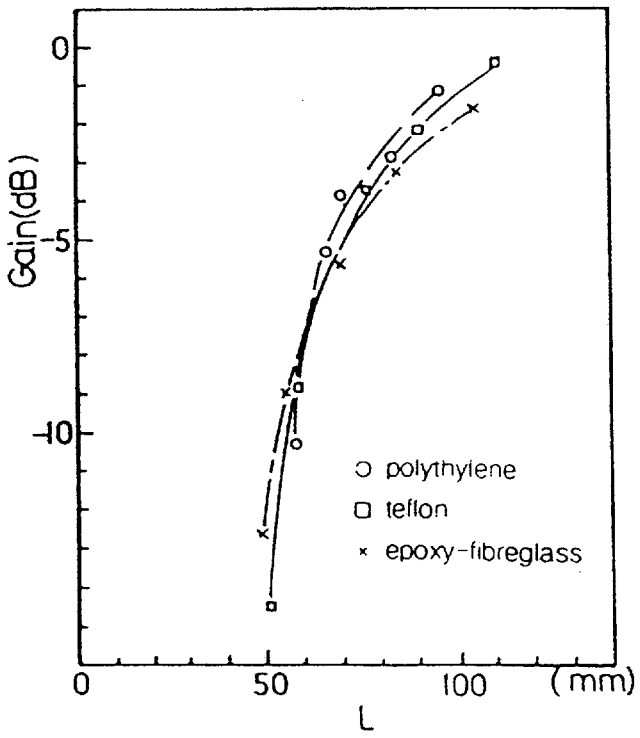
FIG. 4 is a graph illustrating the gain relationship with respect to the whole length L of the antenna of FIG. 2.
Figure 5:
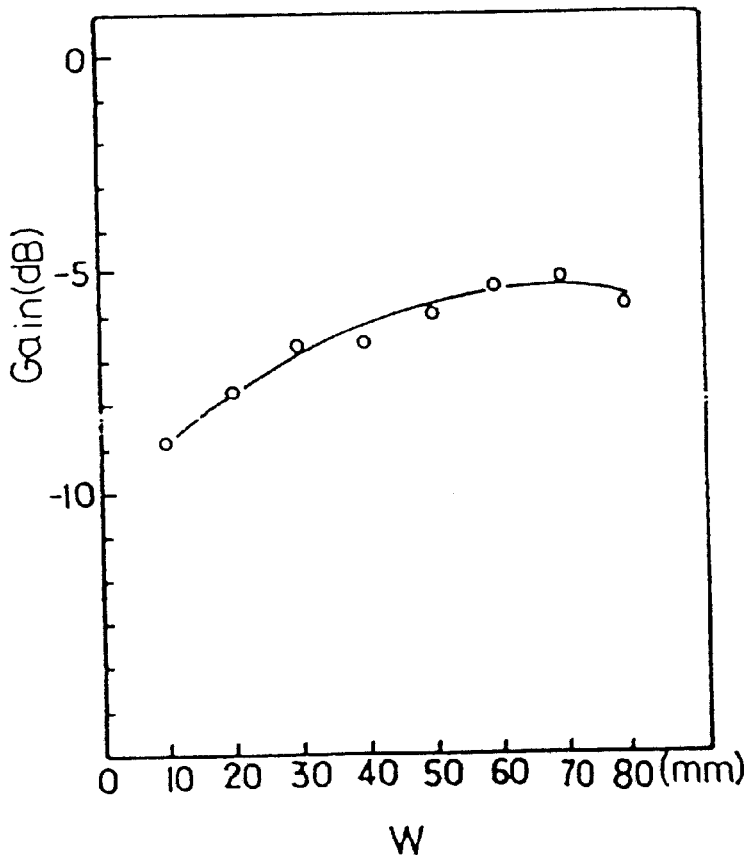
FIG. 5 is a graph illustrating the gain relationship with respect to the width W of the radiation patch 23 of FIG. 2.
Figure 6:
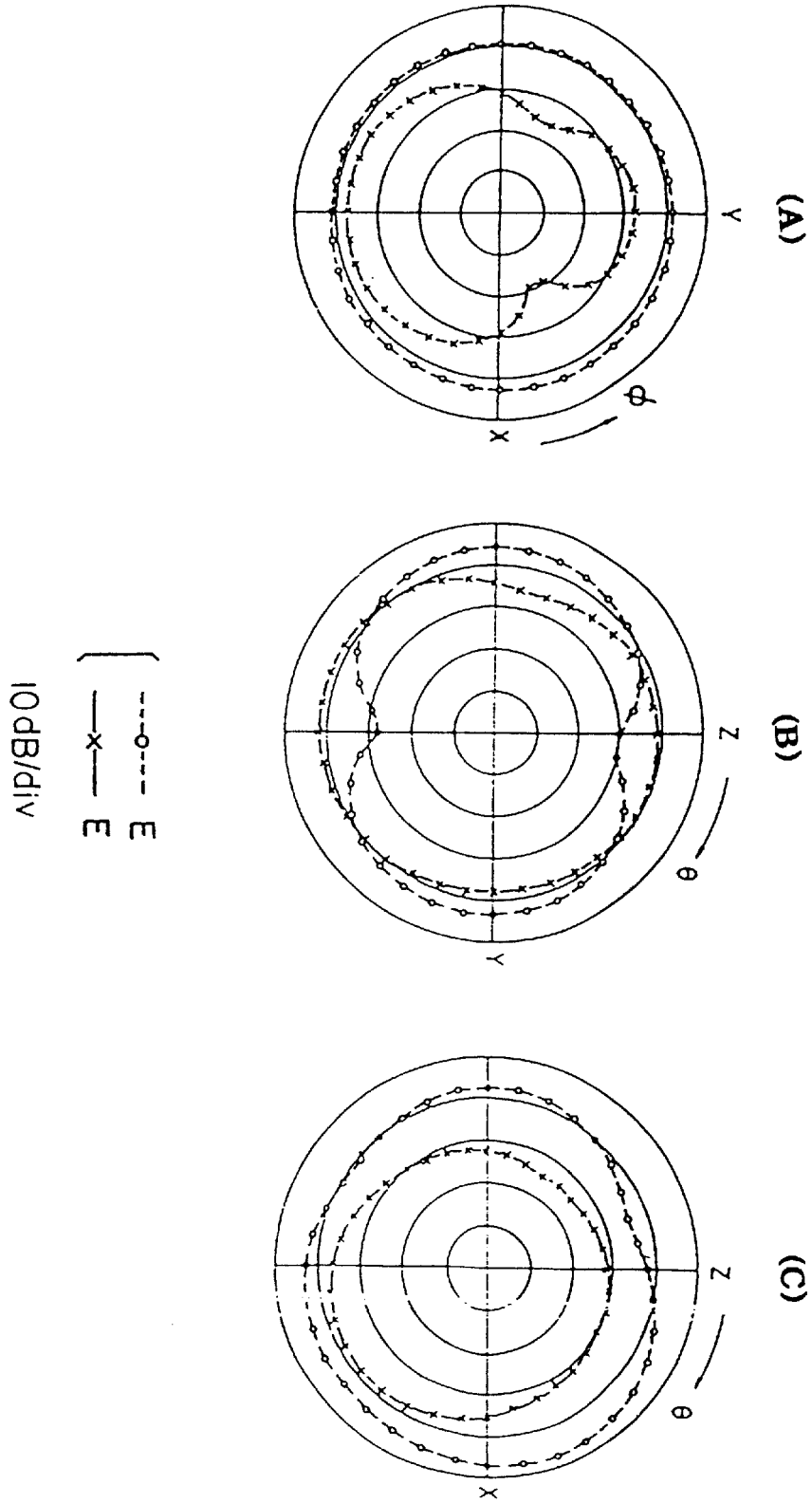
FIG. 6 is a view illustrating the radiation characteristics in XY, YZ, and ZX directions.
Figure 7:
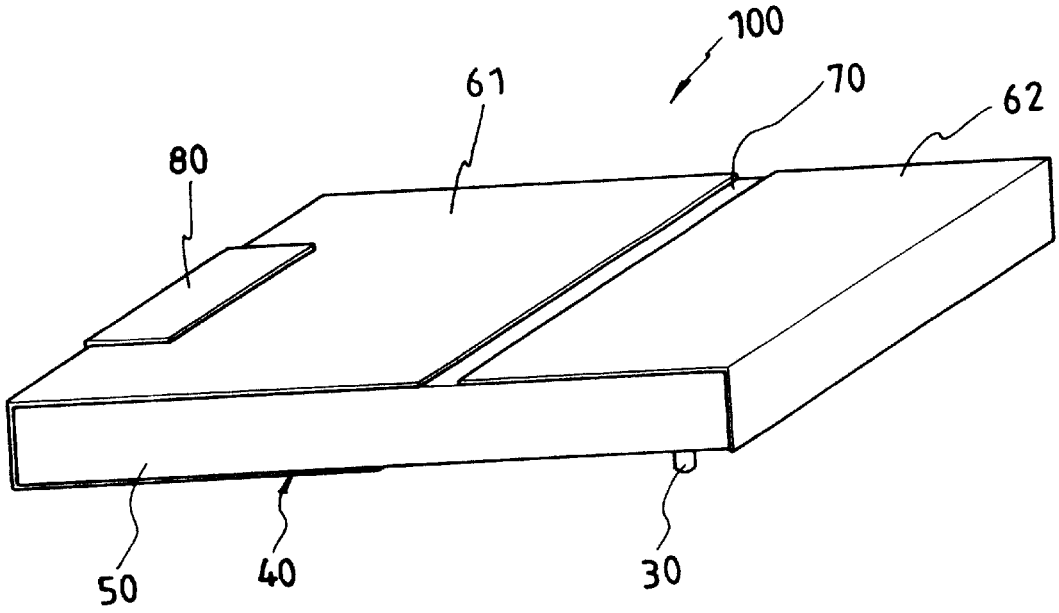
FIG. 7 is a perspective view illustrating the structure of the microstrip antenna according to the present invention.

FIG. 7 is a perspective view illustrating the structure of the microstrip antenna according to the present invention.

The microstrip antenna according to the present invention includes a dielectric 50 laminated on a ground patch 40 as shown in FIG. 7. On the upper surface of the dielectric 50, a left radiation patch 61 is positioned in such a way that it is short-circuited with one end of the ground patch 40, and a right radiation patch 62 is positioned in such a way that it is short-circuited with the other end of the ground patch 40. A gap is provided between the left and right radiation patches (they are apart from each other at a spacing of 0.5 mm, and the gap is referred to as a radiation slot 70).

The microstrip antenna made of such a radiation slot 70 is capable of loading the capacity between the left radiation patch 61 and the right radiation patch 62, such that the formation of the line of electric force is not limited, causing the antenna to be more easily miniaturized. The gain on the capacity-loaded side is increased more than that on the ground patch 40, such that it has a radiation pattern with a larger gain, thereby being preferably used as an antenna in the service band of PCS.

Specifically, the microstrip antenna 100 has a gain which is increased by 1 to 1.76 dB on the capacity-loaded side relative to the ground patch 40, and has a radiation pattern with a maximum electric field of 2 dB which is larger than that of the prior dipole antenna, thereby being preferably used in various wireless devices.

Also, with the microstrip antenna 100 of the present invention, the thickness H1 of the dielectric 50 and the width of the capacity-loaded side can be adjusted to increase or reduce the bandwidth and the gain, and the point position of the feed line 30 can be variably adjusted to eliminate the fringe effect of the feed point of the feed line, thereby overcoming actively the indefinite distribution of the feed line.

Figure 8:
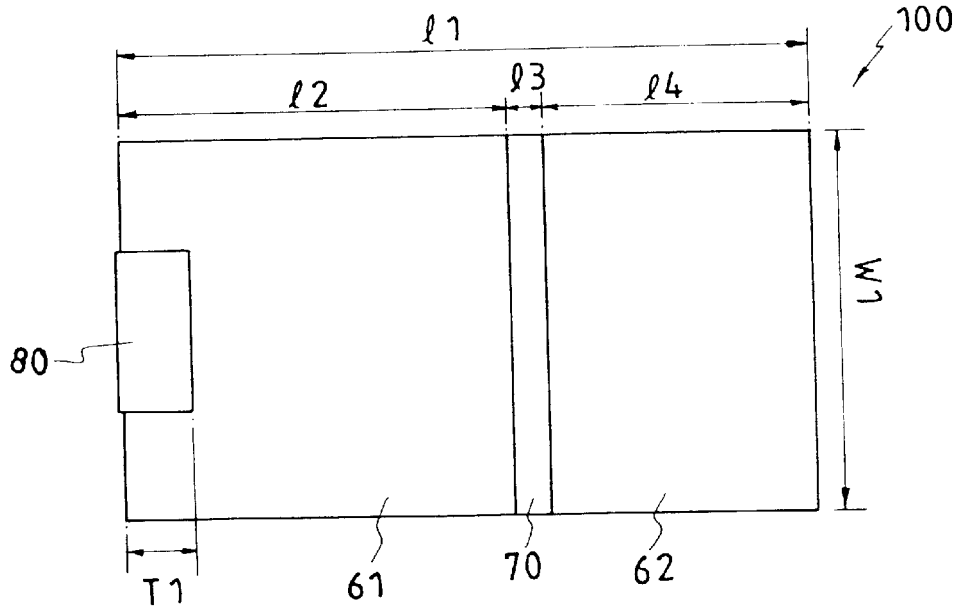
FIG. 8 is a plane view illustrating the structure of the microstrip antenna according to the present invention.

FIG. 8 is a plan view illustrating the structure of the microstrip antenna according to the present invention.

The microstrip antenna 100 of FIG. 8 according to the present invention is an example wherein, when the whole length l1 is 25 mm, the length l2 of the left patch 61 is 14.5 mm, and the length l4 of the right patch 62 is 10 mm, taking into 30 consideration the width of the radiation slot 70, namely, the length l3, corresponding to 0.5 mm, and wherein the width W1 is 15 mm.

Figure 9:
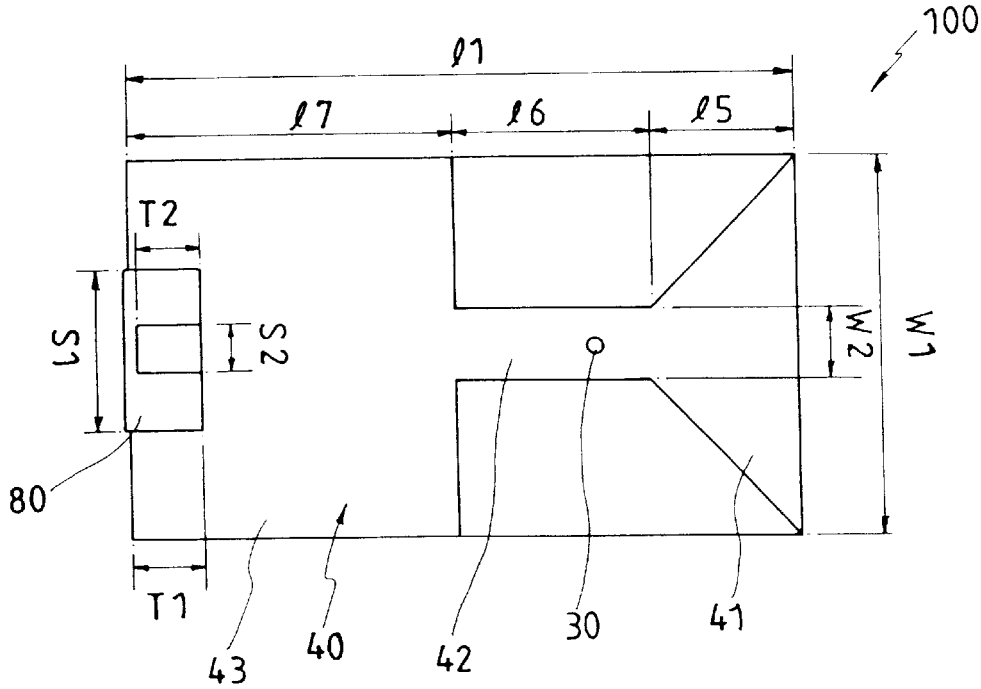
FIG. 9 is a bottom view illustrating the structure of the microstrip antenna according to the present invention.

FIG. 9 is a bottom view illustrating the structure of the microstrip antenna according to the present invention.

As shown in FIG. 9, the ground patch 40 serving as the ground of the microstrip antenna provides a feed line point on which a feed line 30 is positioned. The central conductor of the feed line 30 extends towards the width center of the right radiation patch 62 adjacent to the radiation slot 70 via the ground patch 40 and the dielectric 50. The outer conductor of the feed line 30 is connected to the ground patch 40. The feed line 30 is spaced apart and separated from each of the left and right radiation patches 61 and 62 in a state in which the dielectric 50 is interposed therebetween. By virtue of the dielectric 50, the feed line 30 is electronically coupled to each of the left and right radiation patches 61 and 62.

The ground patch 40 includes a right triangle ground plate 41 having an area extending from the core conductor of the feed line 30 to both corners of the dielectric 50 at which the right radiation patch 62 is short-circuited. The ground patch 40 also includes a connecting plate 42 extending from the core conductor of the feed line 30 towards the left radiation patch 61, and a left ground plate 43 covering the under surface of the dielectric 50.

As shown in FIG. 9, since both sides of the connecting plate 42 of the ground patch 40, to which the feed line 30 is connected, are opened, the current distribution of both sides becomes zero, and the voltage distribution becomes maximum. Preferably, if the whole length of the microstrip antenna 100 is 25 mm, the height l5 of the right ground plate 41 is 5 mm, the length l6 of the connecting plate 42 is 6 mm, and the length l7 of the left ground plate 43 is 14 mm. Additionally, if the whole length l1 of the microstrip antenna 100 is 15 mm, it is preferable to design the microstrip antenna 100 such that the core conductor of the feed line 30 is connected at a point of 7.5 mm distance from an end of the dielectric 50, that is, the center of the width of the dielectric 50, and that the width W2 of the connecting plate 42 is 2 mm. Also, the whole thickness H1 of the microstrip antenna 100 is 3.2 mm, as shown in FIG. 10.

The microstrip antenna 100 according to the above embodiment of the present invention comprises the ground patch 40 with both sides being opened by taking the connecting plate as a standard line, thereby providing inherent characteristics which will be explained below. In order to maintain those inherent characteristics, the ground patch 40 has to be mounted apart from, for example, the printed circuit board of a portable mobile terminal (wireless telephone) to which the microstrip antenna 100 is applied.

Figure 10:
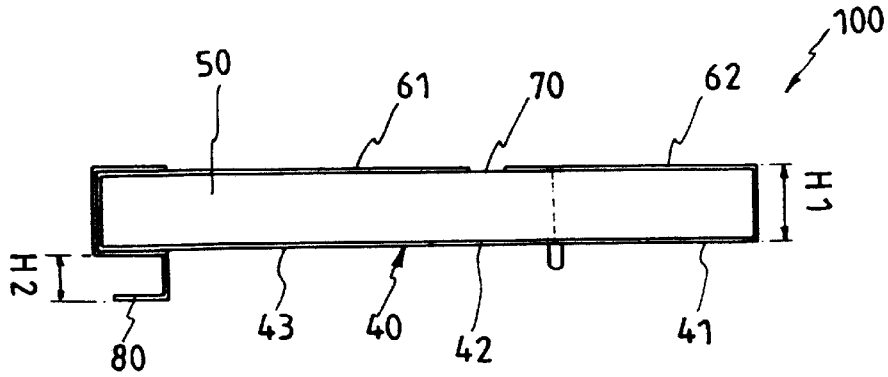
FIG. 10 is a side view illustrating the structure of the microstrip antenna according to the present invention.
Figure 11:
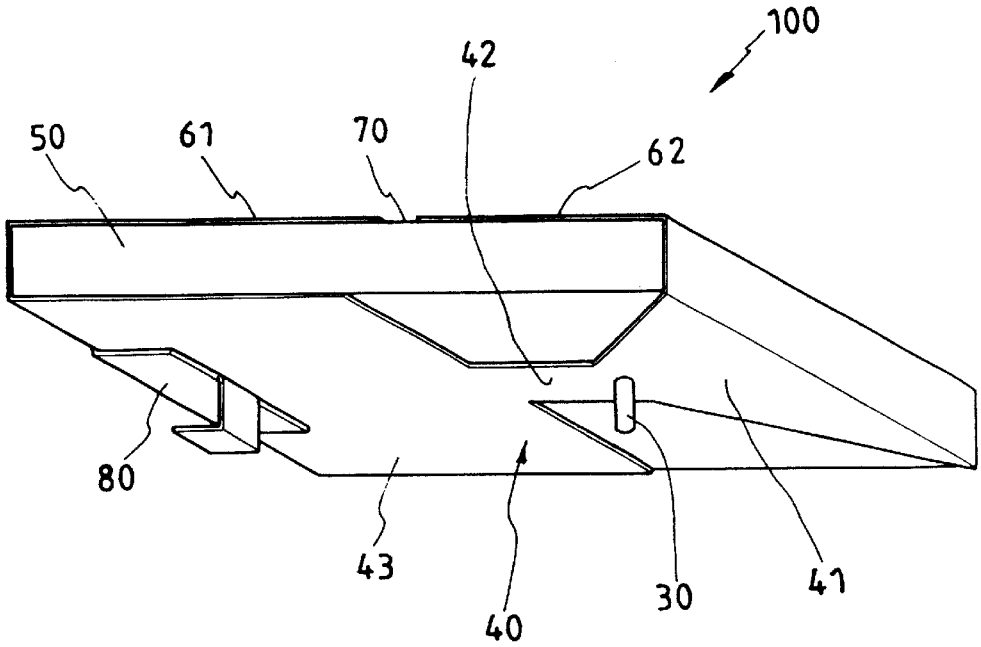
FIG. 11 is a perspective view looking from the bottom of the microstrip antenna according to the present invention.

FIG. 10 is a side view illustrating the structure of the microstrip antenna according to the present invention, and FIG. 11 is a perspective view illustrating the antenna.

In the case that the ground patch 40 is directly mounted on the printed circuit board of the portable mobile terminal, since it is meaningless that both sides are opened by taking the connecting plate 42 as a base line, the ground patch 40 is bent from the center of the left radiation patch 61 to the left ground plate 43 through the side of the dielectric 50, and has a bent mounting piece 80 to provide a height H2 apart from the printed circuit board. The mounting piece 80 maintains the condition of the microstrip antenna 100 apart from the printed circuit board of the mobile terminal, for example an apart height of 3 mm, so that the function of the ground patch 40 can be effected at a maximum.

Preferably, the length T1 of the mounting piece 80 mounted on the upper surface of the left radiation patch 61 and the lower surface of the left ground plate 43 is 3 mm, respectively, and its width S1 is 8 mm, the bent width S2 is 2 mm, and its length T2 is 2.7 mm.

With the above mentioned construction, the microstrip antenna 100 of the present invention is used as a transmission/reception antenna of a flying object such as a rocket, missile, airplane, etc., and may be designed on a circuit board together with solid-state modules such as an oscillator, amplifying circuit, variable attenuator, switch, modulator, mixer, phase shifter, etc.

An explanation will now be given of the embodiment in which the microstrip antenna of the present invention is applied to a portable mobile terminal.

A dipole antenna, a Yagi antenna, or the like is used in the portable mobile terminal. The dipole antenna is a resonance antenna of a half wavelength and has a characteristic of all directional radiation, such that it is used for an antenna of a mobile terminal in cellular communication and a service antenna of a small relay. The Yagi antenna is made of a laminated dipole antenna to enhance directional gain and is used for an antenna of a small relay.

Additionally, the microstrip antenna 100 is used for a personal mobile communication service using a cellular phone and personal communication service, a wireless local looped service, future public land mobile telecommunication system, and variable wireless communication comprising satellite communication to transmit and receive the signal between the base station and the mobile terminal.

Meanwhile, since the prior microstrip laminated antenna is a resonance antenna, it has drawbacks in that it has a very narrow bandwidth of frequency and a low gain. Accordingly, a great number of sheets of patches must be laminated or arrayed. This results in an increase in the size and thickness of the antenna. For this reason, it is difficult for the prior antenna to be mounted on personal mobile terminals, mobile communication repeaters, wireless communication equipment or the like.

The microstrip antenna according to the present invention can minimize leakage current by separately arraying a left radiation patch and a right radiation patch on an upper surface of a dielectric so that they have an electric field of the same phase, and can be minimized in its size and thus can be built in various kinds of wireless communication equipment such as portable mobile terminals by improving its standing-wave ratio and gain so that it has a wide bandwidth.

Figure 12:
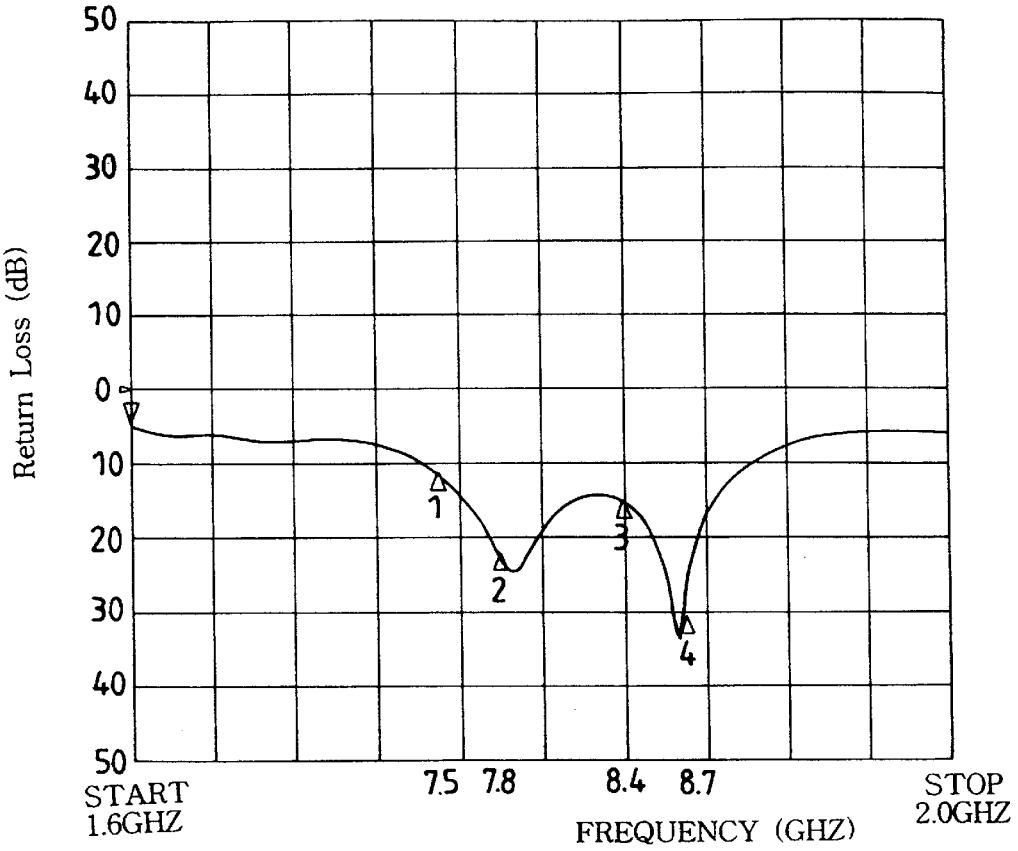
FIG. 12 is a graph illustrating the return loss with respect to the frequency of the microstrip antenna according to the present invention.

FIG. 12 is a graph illustrating the return loss with respect to the frequency of the microstrip antenna according to the present invention.

It will be noted from FIG. 12 that in the microstrip antenna according to the present invention, its service band is in the range of 1,750 to 1,870 MHz, and its bandwidth is above 120 MHz (above about 160 MHz), so that it can be more easily adapted to the personal communication service.

Specifically, the microstrip antenna according to the present invention shows that since the reflecting loss in the range of 1,750 to 1,870 MHz is −10 dB, the loss value to the reflecting current is very preferable. Further, its bandwidth is maintained widely on the order of 120 MHz.

Figure 13:
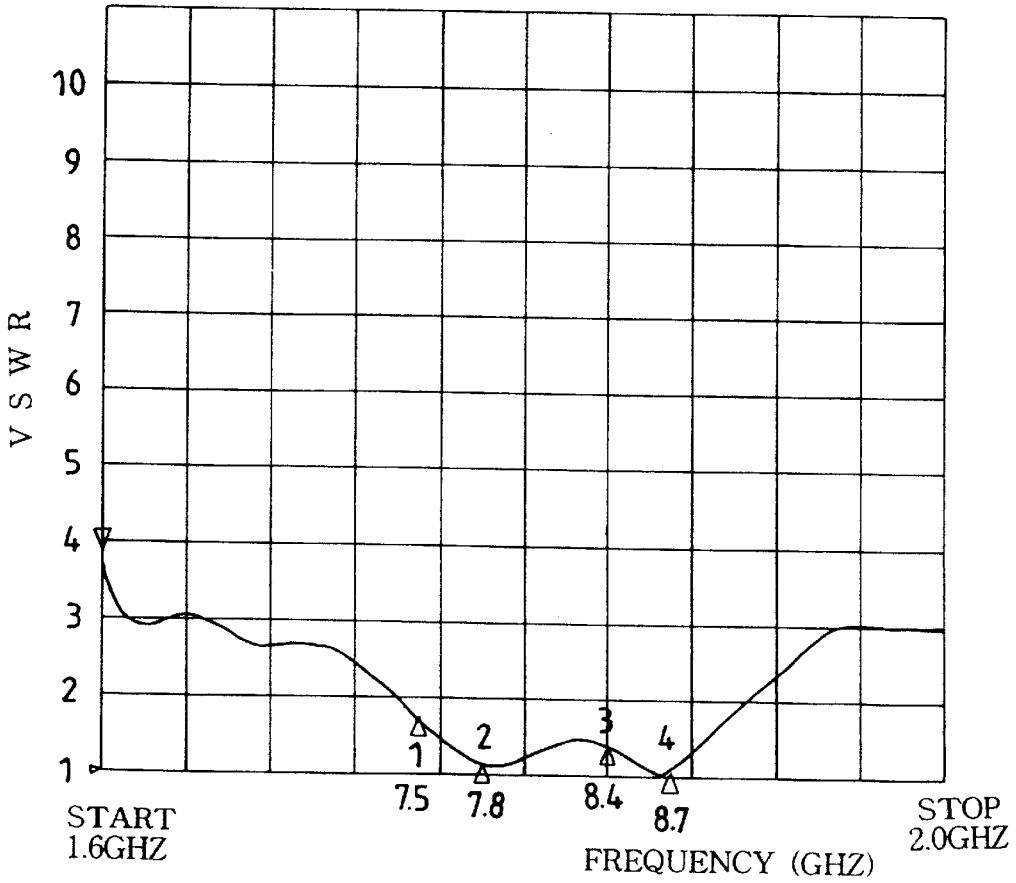
FIG. 13 is a graph illustrating the standing-wave ratio with respect to the frequency of the microstrip antenna according to the present invention.

FIG. 13 is a graph illustrating the standing-wave ratio with respect to the frequency of the microstrip antenna according to the present invention, in which the maximum standing-wave ratio to the resonance impedance of 50Ω in a frequency band of personal communication service is 1:1.06 to 1.76.

Supposing that the ideal standing-wave ratio is 1 in the microstrip antenna, at marker 1 the standing-wave ratio is 1.768 and the frequency is 1.75000 GHz, at marker 2 the standing-wave ratio is 1.1613 and the frequency is 1.78000GHz, at marker 3 the standing-wave ratio is 1.4269 and the frequency is 1.84000 GHz, and at marker 4 the standing-wave ratio is 1.80664 and the frequency is 1.87000 GHz. Accordingly, the standing-wave ratio to the resonance impedance of 50Ω in the bandwidth of 0.12 GHz is preferably realized.

Further, the radiated gain of the microstrip antenna 100 of the present invention should be effectively achieved for the transmission/reception with the base station or the relay station. As the result of a measurement for radiated gain conducted in a room in which electromagnetic waves are not reflected, it can be found that a radiated gain of 0.5 to 1.3 dB is obtained in all directions.

Figure 14:
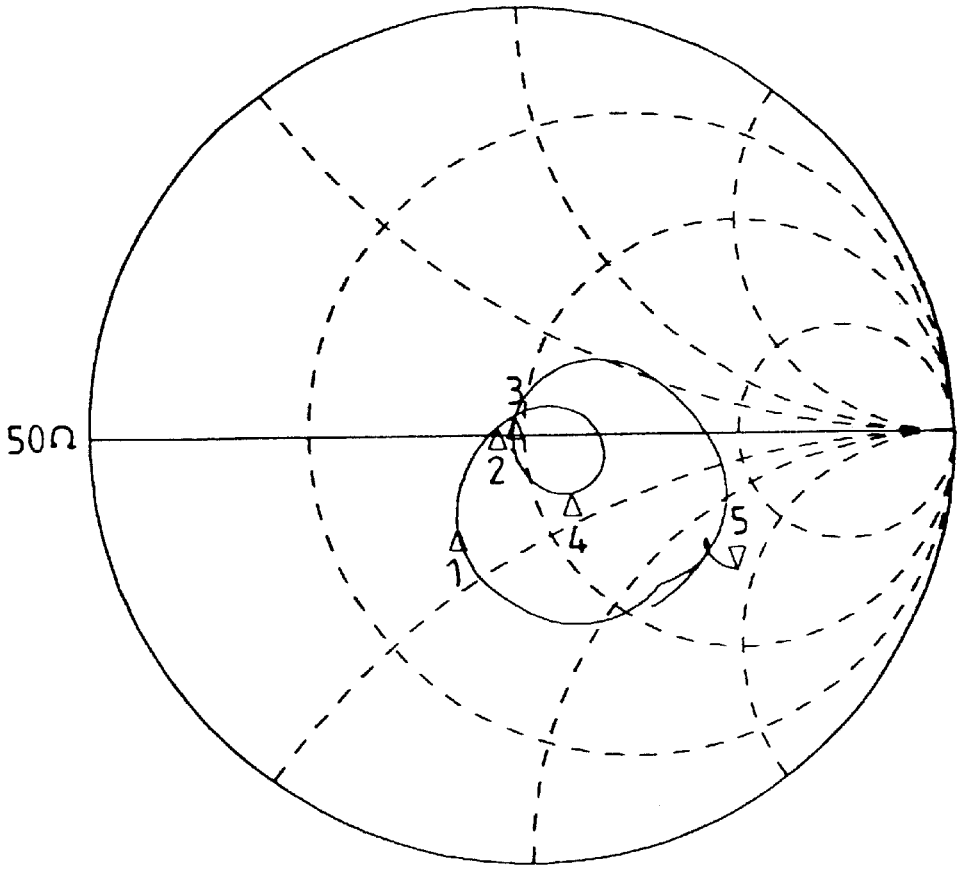
FIG. 14 is a Smith chart explaining the microstrip antenna according to the present invention.

FIG. 14 is a Smith chart explaining the microstrip antenna according to the present invention.

Supposing that the resonance impedance is 50Ω in the frequency band of the personal communication service, at marker 1 the impedance is 33.660Ω and the frequency is 1.75000 GHz, at marker 2 the impedance is 44.160Ω and the frequency is 1.78000 GHz, at marker 3 the impedance is 59.616Ω and the frequency is 1.84000 GHz, and at marker 4 the impedance is 47.846Ω and the frequency is 1.87000GHz. Accordingly, the resonance impedance in the bandwidth of 0.12 GHz is realized in a range of 34 to 60Ω, and, in particular, the resonance impedance in the markers 1 and 2 is nearly 50Ω.

Figure 15:
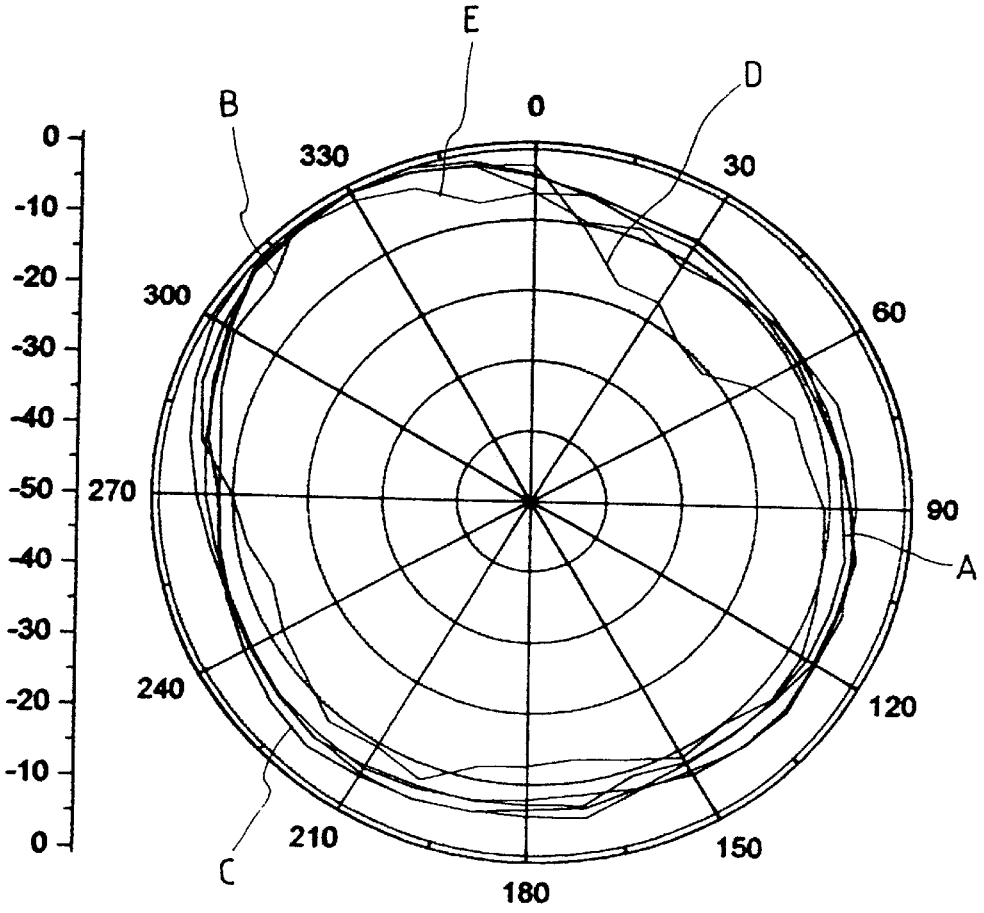
FIG. 15 is a view of the radiation pattern explaining the microstrip antenna according to the present invention.

FIG. 15 is a view of the radiation pattern explaining the microstrip antenna according to the present invention.

The microstrip antenna according to the present invention realizes an omni-direction pattern as shown in FIG. 15, thereby solving the directional problem.

It will be noted that Y axis shows an amplitude value as dB, a line A shows 1.74 GHz, a line B shows 1.78 GHz, a line C shows 1.8 GHz, a line D shows 1.84 GHz, and a line E shows 1.87 GHz, thereby achieving the omni-directional pattern.

With the above mentioned constitution, because a leak current does not flow in the outer conductor of the feed line 30, it is not necessary to provide a matching circuit in the portable wireless system. Further, since it is made by loading its capacity, the electric line of power between the ground patch 40, the right radiation patch 62 and the left radiation patch 61 is not limited, thereby making its size small without diminishing its gain.

Because the left radiation patch 61 and the right radiation patch 62 are divided by the radiation slot 70 to cause the entire radiation patch to have an electric field of the same phase, it is possible to solve the low reception sensitivity.

Specifically, the microstrip antenna 100 has a gain which is increased by 1 to 1.76 dB on the capacity-loaded side relative to the ground patch 40, and has a radiation pattern with a maximum electric field of 2 dB larger than that of the prior dipole antenna, so that it can be effectively used as an antenna for bands of PCS services.

Also, with the microstrip antenna 100 of the present invention, the thickness H1 of the dielectric 50 and the width of the capacity-loaded side can be adjusted to increase or in reduce its bandwidth gain, and the feed point of the feed line 30 can be variably adjusted to eliminate occurrence of a fringe effect at the feed point of the feed line, thereby effectively overcoming the indefinite distribution of the feed line.

Also, an increase in gain occurs at the capacity-loaded part rather than at the ground patch 40. As a result, the microstrip antenna 100 of the present invention can have a radiation pattern of larger gain.

The microstrip antenna of the present invention is used as a transmission/reception antenna of a flying object such as a rocket, missile, airplane, etc., and may be designed on the substrate together with solid-state modules such as an oscillator, amplifying circuit, variable attenuator, switch, modulator, mixer, phase shifter, etc. Additionally, the microstrip antenna is used for a personal mobile communication service using a cellular phone and personal communication service, a wireless local looped service, future public land mobile telecommunication system, and variable wireless communication comprising satellite communication to transmit and receive the signal between the base station and the mobile terminal.

Although the present invention has been described with reference to the specification and drawings, it is understood that this description is not to limit the invention to the embodiments shown in the drawings, but simply to explain the invention. One skilled in the art will understand that various changes and modifications can be made from the embodiments disclosed in the specification. Therefore, the scope of the present invention should be defined by the appended claims.

What is claimed is:

1. A microstrip antenna (100) comprising a ground patch (40) on which at least a feed line (30) is located, and a dielectric (50) laminated on the ground patch (40), further comprising:

a first radiation patch (61) short-circuited to one end of the ground patch (40) and laminated on a first upper surface of the dielectric (50), and a second radiation patch (62) short-circuited to the other end of the ground patch (40) and laminated in an array on a second upper surface of the dielectric (50) with a radiation slot (70) arranged between the first and second radiation patches (61) and (62) so that capacitance is implemented between the first and second radiation patches (61 and 62); and wherein the ground patch (40) includes a second ground plate (41) having a triangle shape formed by a feed point of a feed line (30) and both corners of a second lower surface of the dielectric (50) to which the second radiation patch (62) is short-circuited, a connection plate (42) having a width (W2) and extending as long as a height (l5) of the second ground plate (41) from the feed point to the first radiation patch (61) to implement an inductance, and a first ground plate (43) connected to the connection plate (42) and covering a first lower surface of the dielectric (50).

2. The microstrip antenna (100) as claimed in claim 1, further comprising a mounting piece (80) having a bent shape and attached to a center portion of a first end of the first radiation patch (61), one side surface of the dielectric (50), and the first ground plate (43) to provide a height (H2) for enabling the ground patch (40) to be separately mounted.

* * * * *